US006276682B1

(12) United States Patent
Yamashita et al.

(10) Patent No.: US 6,276,682 B1
(45) **Date of Patent: *Aug. 21, 2001**

(54) AIR HOCKEY GAME APPARATUS

(75) Inventors: Akihisa Yamashita; Kojiro Minami; Eita Kada; Hideki Kotani; Yusuke Fujimoto; Hajime Dohki, all of Kobe (JP)

(73) Assignee: Konami Co., Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/488,116

(22) Filed: Jan. 20, 2000

(30) Foreign Application Priority Data

Jan. 21, 1999 (JP) ..... 11-013648

(51) Int. Cl.[7] ..... A63F 7/00
(52) U.S. Cl. ..... 273/126 A
(58) Field of Search ..... 273/108, 108.1, 273/118 R, 118 A, 119 R, 119 A, 121 R, 121 A, 126 R, 126 A, 127 R

(56) References Cited

U.S. PATENT DOCUMENTS 3,931,947 * 1/1976 Goldfarb et al. ..... 273/126 R
4,032,150 * 6/1977 Wilson ..... 273/126 R
4,971,324 * 11/1990 Grabel et al. ..... 273/129 V
5,104,607 * 4/1992 Driska ..... 273/126 A X
5,788,231 * 8/1998 To ..... 273/126 R
5,931,465 * 8/1999 Miyake et al. ..... 273/126 A X
6,105,960 * 8/2000 Carames ..... 273/126 A X

FOREIGN PATENT DOCUMENTS 09-322978 12/1997 (JP) .

* cited by examiner

*Primary Examiner*—Raleigh W. Chiu
(74) *Attorney, Agent, or Firm*—Jordan and Hamburg LLP

(57) ABSTRACT

An air hockey game apparatus provides appropriate dynamic characteristics to the game, thereby effectively improving amusement characteristics of the game. The air hockey game apparatus has a puck sliding surface having blowholes for blowing air to float a puck, an air-blower for blowing and sending air toward blowholes, a puck-reflecting frame around the puck sliding surface, goals on the puck sliding surface, blocking members in the individual goals, opening/closing driving units for changing the open sizes of the individual goals by using the blocking members, and a controller for controlling the opening/closing driving units, thereby allowing competition for entering the puck into the goals.

69 Claims, 16 Drawing Sheets

AIR HOCKEY GAME APPARATUS

BACKGROUND OF THE INVENTION

1. Field of the Invention

The present invention relates to an air hockey game apparatus with which game players compete with each other in hitting a puck into a goal. Particularly, the invention relates to an air hockey game apparatus that has a puck sliding surface having blowholes for floating the puck, an air-blower for transferring air into the blowholes, a puck-reflecting frame provided on the puck sliding surface, and goals provided on the puck sliding surface.

2. Description of the Related Art

Among air hockey game apparatuses that have been suggested and that are being sold, for example, Japanese Unexamined Patent Publication No. 9-322978 discloses an air hockey game apparatus that allows game players to hit a puck into a goal at the end of the opponent. The puck floats on the baseboard that has a large number of blowholes. Each of the goals is partially or completely blocked by a goal barrier. The goal barrier is held at a position where the goal is blocked when a push button provided on a rear side of the goal barrier is pushed down against a spring force to slide in one direction. When the push button is horizontally slid in the opposite direction, and the pushing force is relieved, the goal is urged by the spring force to open.

As described above, the described configuration allows open sizes of the goals to be changed according to operation of pushing the push buttons, thereby allowing a handicap to be provided corresponding to the skill of the game players. However, changing the open sizes of the goals during the game is difficult. Also, the game players are permitted to operate the push button provided on their individual sides at their own discretion, thereby changing the open sizes of the goals. In this case, dynamic characteristics cannot be provided in the game, therefore, the game is apt be monotonous.

SUMMARY OF THE INVENTION

Under these circumstances, an object of the present invention is to provide an air hockey game apparatus that can cause appropriate events in the game, thereby effectively improving amusement characteristics of the game.

An air hockey game apparatus of the present invention has a puck sliding surface having blowholes for blowing air to float a puck, an air-blower for blowing and sending air toward the blowholes, a puck-reflecting frame around the puck sliding surface, goals on the puck sliding surface, blocking members in the goals, opening/closing driving units for changing the open sizes of the goals by using the blocking members, and a controller for controlling the opening/closing driving units, thereby allowing competition for entering the puck into the goals.

With the described configuration, the blocking members are driven by the opening/closing driving units to correspond to a scoring status and movement of the puck, and the open sizes of the goals are changed by the blocking members. This provides dynamic characteristics to the game, thereby allowing amusement characteristics to be improved.

In the described air hockey game apparatus, the controller may be arranged to control operational conditions of the blocking members so as to gradually change the open sizes of the goals. According to this arrangement, the open sizes of the goals are gradually changed so as to correspond to the scoring status and movement of the puck, thereby improving dynamic characteristics and the like of the game.

Also, in the described invention, each of the opening/closing driving units may be arranged to include a driving motor and a power transmission mechanism for transmitting power of the driving motor to the blocking member. According to this arrangement, the blocking members can be driven so as to perform quick and smooth operation according to the driving power inputted from the driving motor via the power transmission mechanism.

Also, the described invention may be arranged such that each of the blocking members is rotatably supported with a vertical axis in the center, has a blocking face spreading in an arcuate shape with the vertical axis in the center, and is rotationally displaced according to driving force of the driving motor which is transmitted by the power transmission mechanism. In this arrangement, the blocking members operate to change the open sizes of the goals easily and safely corresponding to the rotational position of the blocking members that are rotationally displaced with the vertical axis in the center.

Also, the invention may be arranged to further have inputting devices for inputting and specifying the open sizes of the goals, wherein the controller controls the operational conditions of the blocking members to change the open sizes of the goals according to input signals of the inputting device. In this arrangement, the operational conditions of the blocking members are controlled to change the open sizes of the goals according to the input signals of the inputting devices, thereby preliminarily providing handicaps depending on the difference in skills of the game players. This makes the game to be played for fair and strong competition, thereby allowing effective improvement in amusement characteristics to be achieved.

Also, the described invention may be arranged to further include a determination unit for determining the game status, wherein the control device controls the operational conditions of the blocking members to change the open sizes of the goals according to the game status determined by the determination unit. According to this arrangement, the open sizes are changed so that one of the game players is placed in a disadvantageous position depending on a game status determined by the status determination unit. This allows amusement characteristics to be improved.

Also, the described invention may be arranged such that the status determination unit determines the game status according to scores of the air hockey game. According to this arrangement, the open sizes are changed so that, for example, one of the game players who achieved a high score is placed in a disadvantageous position depending on the scores of the air hockey game. This allows the game to be played for fair competition, thereby allowing effective improvement in amusement characteristics to be achieved.

Also, the described invention may be arranged to further include reacting devices for reacting to movement of the puck, wherein the control device controls the drive conditions of the blocking devices to change the open sizes of the goals. In this arrangement, the controller controls the operational conditions of the blocking members to change the open sizes of goals according to results obtained by the reacting devices, which are unforeseeable to the game players. This allows effective improvement in the dynamic characteristics of the game to be achieved.

In addition, the described invention may be arranged such that a pair of goals is provided on the puck sliding surface so as to oppose each other. According to this arrangement, enjoyment can be effectively obtained in match games that allow two game players to compete with each other for scores in entering the puck into the goal at the opposing end.

Furthermore, the described invention may be arranged to further include displaying devices for displaying the open sizes of the goals opened or shut by the blocking devices. According to this arrangement, the game players can effectively recognize the open sizes of the goals, which are displayed on the displaying devices, thereby, allowing improvement in amusement characteristics of the game to be achieved.

DESCRIPTION OF THE PREFERRED EMBODIMENTS

Figure 1:
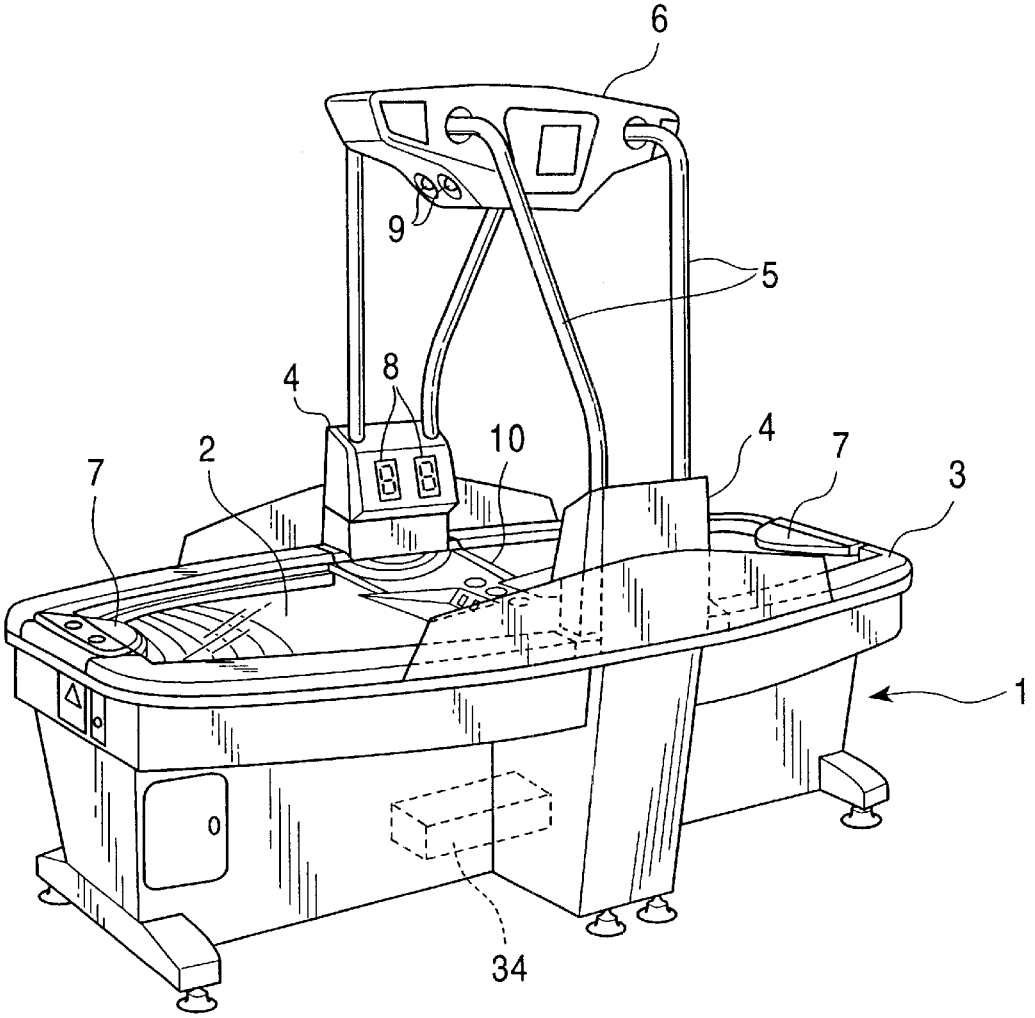
FIG. 1 is a perspective view of an air hockey game apparatus according to an embodiment of the present invention.
Figure 2:
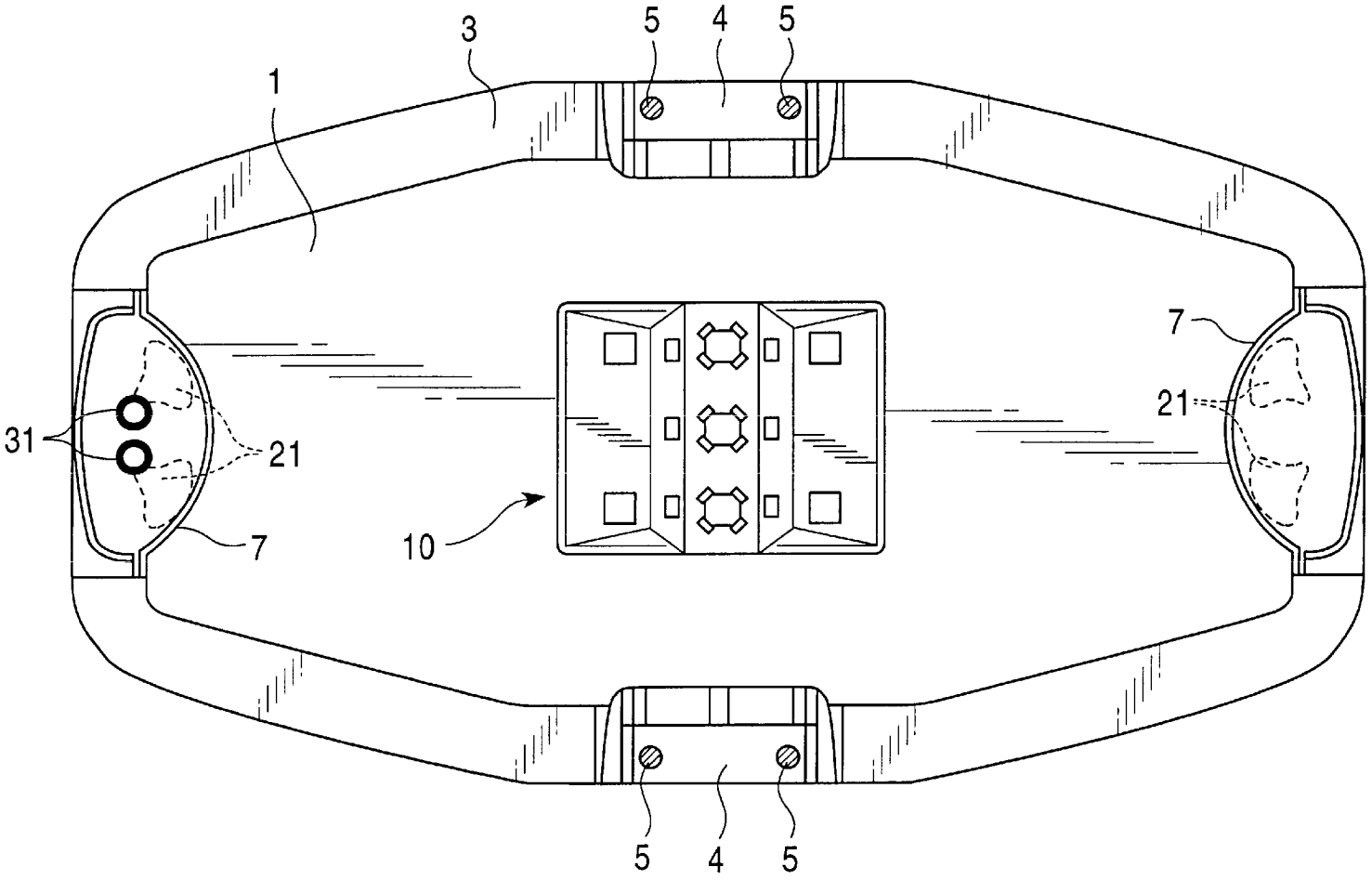
FIG. 2 is a plan view of the overall configuration of the air hockey game apparatus.

FIGS. 1 and 2 show the overall configuration of an air hockey game apparatus according to the present invention.

The air hockey game apparatus has a base 1, a puck sliding surface 2, a peripheral wall section 3 (puck-reflecting frame), a pair of side blocks 4, and an upper block 6. The puck sliding surface 2 is mounted on the base 1. The peripheral wall section 3 surrounds the puck sliding surface 2, thereby forming a puck-reflecting frame. The side blocks 4 are provided at right and left side sections of the peripheral wall section 3. The upper block 6 is supported by supporting frames 5 mounted on the pair of side blocks 4. Goals 7 are individually provided at two ends in the front-to-rear on the puck sliding surface 2. The individual goals 7 have openings which oppose each other, toward which the puck is hit.

An air-blower 13 (to be described below) for transferring air toward the puck sliding surface 2 is provided in the base 1. Air transferred by the air-blower 13 blows upward from blowholes 40 formed of many small openings (shown in FIG. 3) on the puck sliding surface 2, thereby floating the puck which is shaped like a disc. With the puck floating, individual game players, each holding a hitting tool called a mallet, hit the puck into the goals 7 at the sides of the game player acting as an opponent, thereby competing for scores.

Score displays 8 for displaying scores of the game players are provided on at least one of the side blocks 4. Also, illuminators (not shown) are provided. The illuminators include, for example, spotlights for emitting light toward predetermined positions on the puck sliding surface 2, such as toward the goals 7. An audio unit 9 includes, for example, speakers for producing sound.

Figure 3:
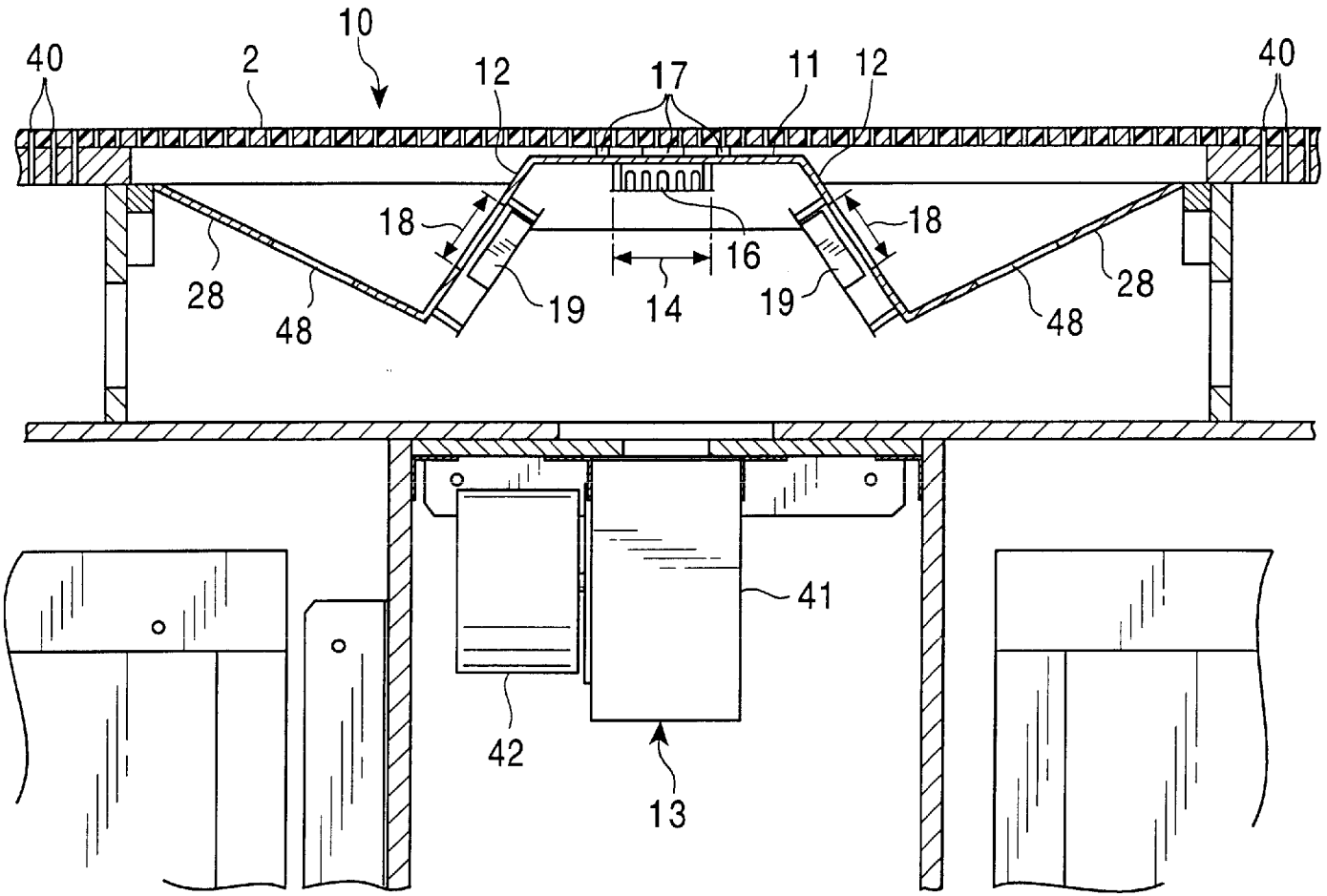
FIG. 3 is a cross-sectional view of the interior configuration of the air hockey game apparatus.
Figure 4:
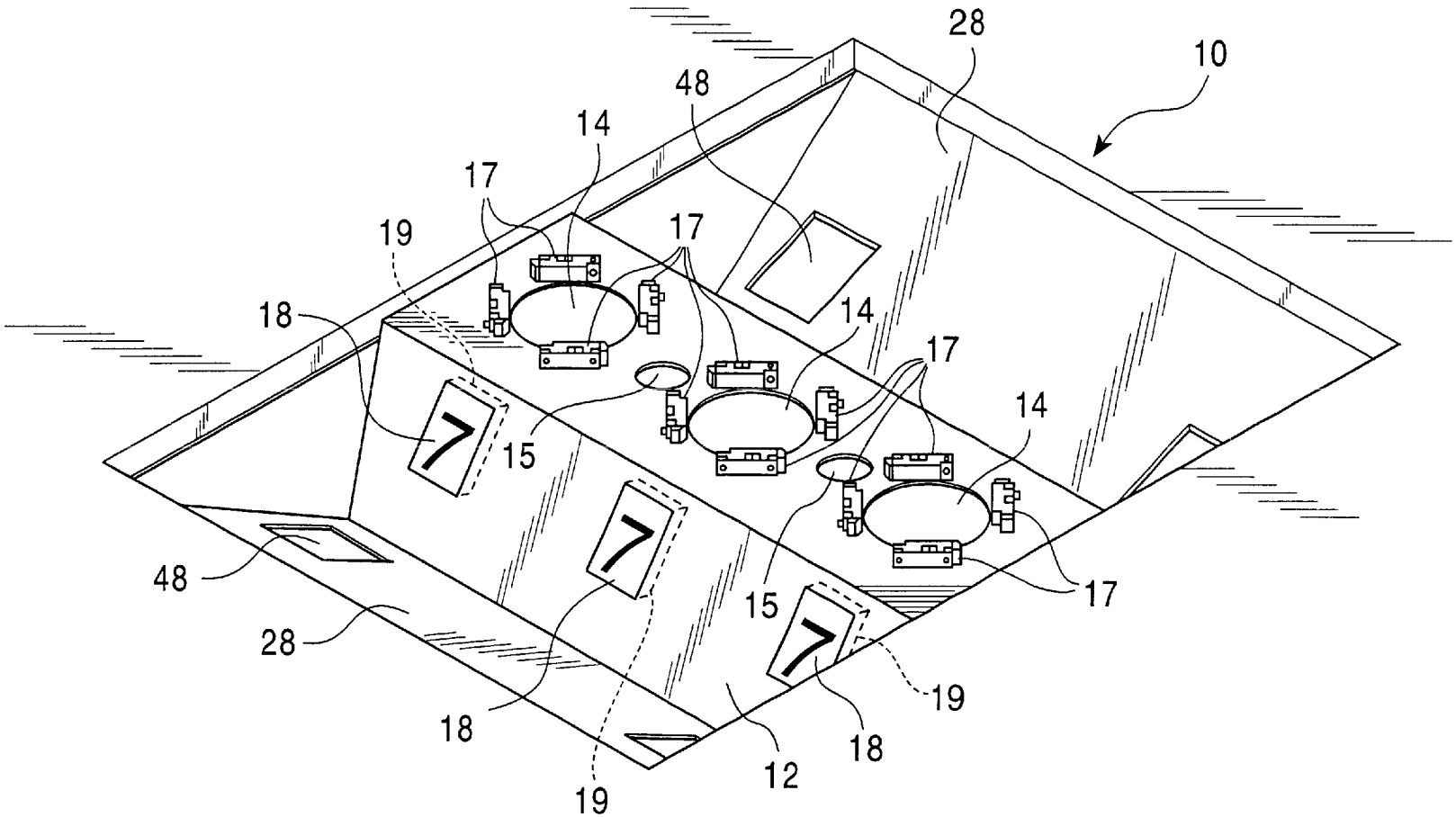
FIG. 4 is a perspective view of the interior configuration of the air hockey game apparatus.

The puck sliding surface 2 is formed of a material, such as an acrylic-resin transparent board, which has transmissive characteristics. Also, as shown in FIGS. 3 and 4, a horizontal plate 11, a pair of sloping plates 12, a pair of sloping plates 28, and the air-blower 13 are provided under a central portion 10 of the puck sliding surface 2. The horizontal plate 11 has a predetermined width and extends in a right-to-left direction along a lower surface of the puck sliding surface 2. The individual sloping plates 12 extend diagonally downward from the front and rear ends of the horizontal plate 11. The individual sloping plates 28 extend diagonally upward from ends of the sloping plates 12. The air-blower 13 consists of a blowing fan 41 and a driving motor 42 and is provided under the horizontal plate 11.

The horizontal plate 11 has three large openings 14 serving as air-communicating openings, and two small openings 15 are provided between the large openings 14. Three luminophors 16 made of light-emitting diodes are provided so as to face the large openings 14. Four puck detectors 17 individually made of light-sensitive detectors are provided around each of the large openings 14. The puck detectors 17 oppose the puck sliding surface 2 so as to detect the movement of the puck. When the luminophors 16 are turned on to illuminate or to blink, light is emitted upward through the large openings 14 and the puck sliding surface 2 which is transparent. According to this arrangement, the game players can visually recognize the positions where the puck detectors 17 are installed.

Each of the sloping plates 12 has three openings 18 at positions corresponding to the puck detectors 17, and segmented roulette displays 19 (reacting units) are provided so as to face the openings 18. The roulette displays 19 are mounted on display-mounting plates, i.e., on the sloping plates 12, so as to oppose positions where game players stand at the front end and the rear end of the base 1. Thus, in the above arrangements, the roulette displays 19 are visible through the puck sliding surface 2 which is transparent. Therefore, the game players can see digits or other items displayed on the roulette displays 19.

Also, under the transparent puck sliding surface 2, spaces partitioned by partitioning plates formed of the sloping plates 12, which individually form the display-mounting plates, and the sloping plates 28 are provided. The individual sloping plates 28 have guide openings 48 for guiding air transferred from the air-blower 13. The transferred air is guided into the abovementioned spaces from the guide openings 48 formed on the sloping plates 28 (partitioning plates), the air is then guided to blow up from the puck sliding surface 2 from the blowholes 40 provided on the puck sliding surface 2. In a preferable arrangement, the horizontal plate 11, the sloping plates 12 and 28, the luminophors 16, the puck detectors 17, and the roulette displays 19 are integrated as a single unit. This is preferable because the unit is removable from the base 1.

Figure 5:
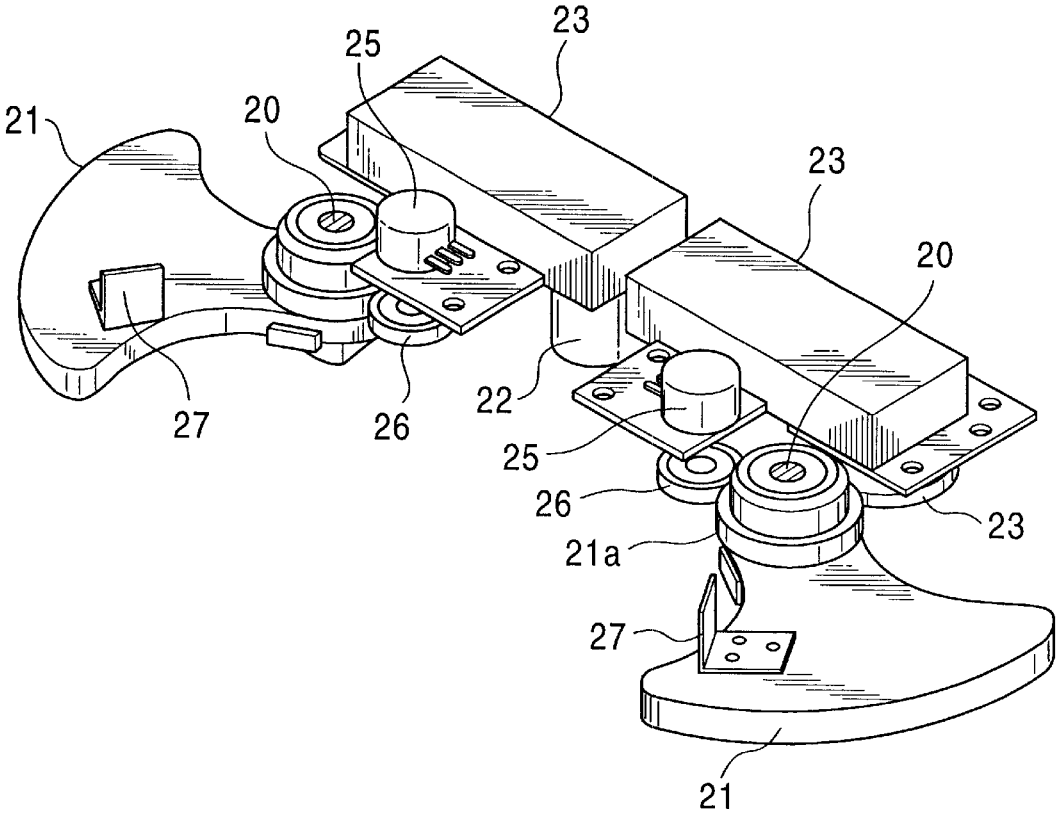
FIG. 5 is a detailed perspective view of the configuration of a driving unit of a blocking member.
Figure 6:
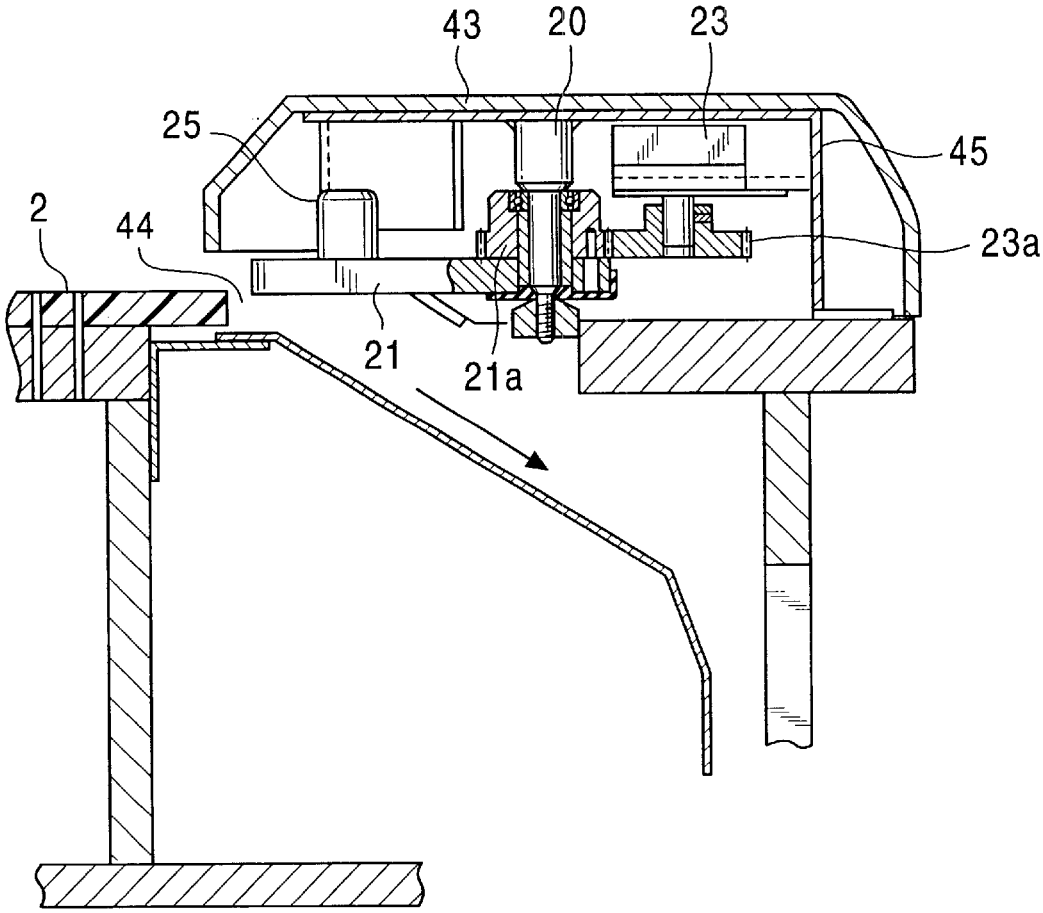
FIG. 6 is a detailed cross-sectional view of a goal.
Figure 10:
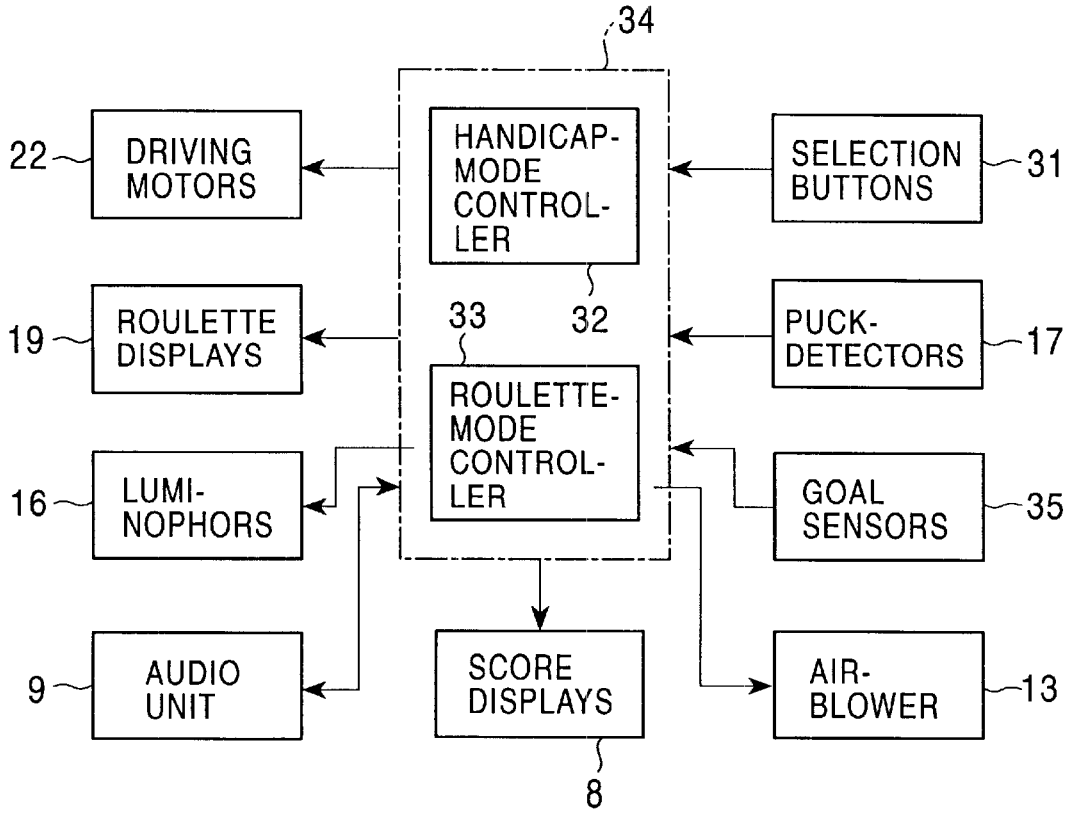
FIG. 10 is a schematic view showing the configuration of a control section in detail.

As shown in FIGS. 5 and 6, each of the goals 7 has an upper cover 43, a puck-passing opening 44, and a goal sensor 35 (shown in FIG. 10). The upper cover 43 is provided so as to partly extend inward from the peripheral wall section 3 at positions at the front and rear ends of the puck sliding surface 2, and the puck-passing opening 44 has a cut opening formed there. The goal sensor 35, which is made of a passing sensor or the like and is provided in the pack-passing opening 44 senses the puck hit into the goal 7. For the above, an alternative arrangement may have a goal having a concave section or a convex section on either the puck sliding surface 2 or the peripheral wall section 3. Another alternative arrangement may be such that a goal is simply marked, or a collision sensor or impact sensor may be used as a goal sensor.

Each of the goals 7 also has components such as a supporting bracket 45, a supporting axis 20, a blocking member 21, a driving motor 22 (opening/closing driving unit), and a power transmission mechanism. The supporting bracket 45 is provided in the upper cover 43. The supporting axis 20 is symmetric with respect to its right and left sides, extends vertically, and is fitted to the supporting bracket 45. The blocking member 21 is rotatably supported by a vertical axis, that is, the supporting axis 20. The blocking member 21 is formed in an arcuate shape. It has a blocking face spreading as an arc with the vertical axis in the center. The power transmission mechanism consists of components such as a gearbox 23 to be driven by the driving motor 22.

Figure 7:
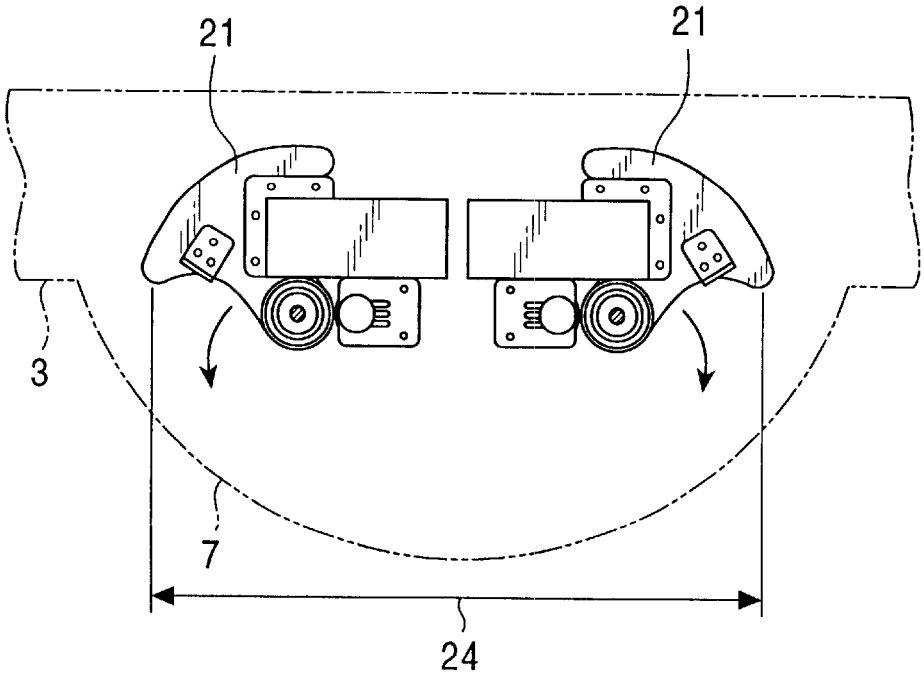
FIG. 7 is a view of the goal when fully open.
Figure 8:
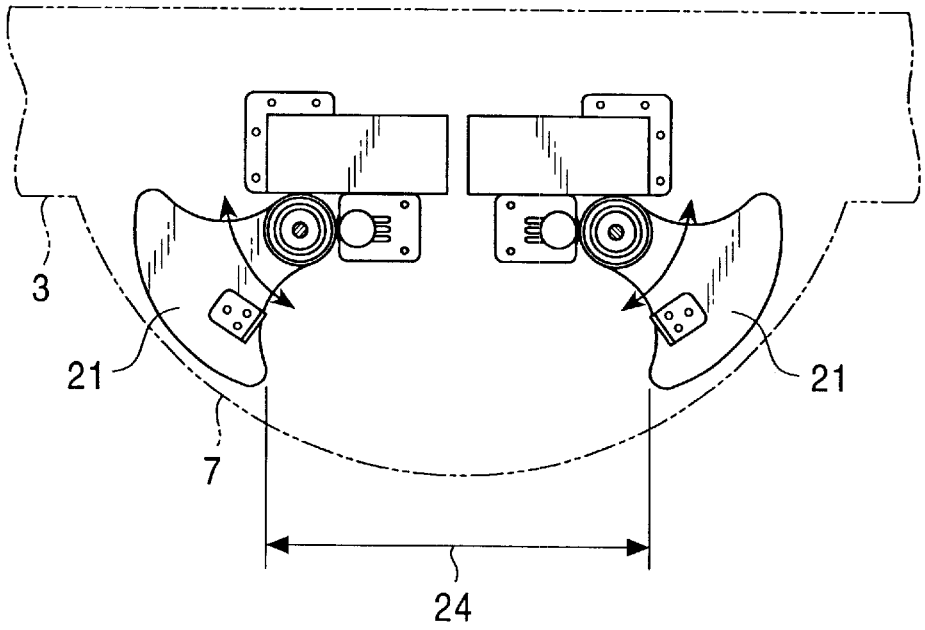
FIG. 8 is a view of the goal when semi-opened.
Figure 9:
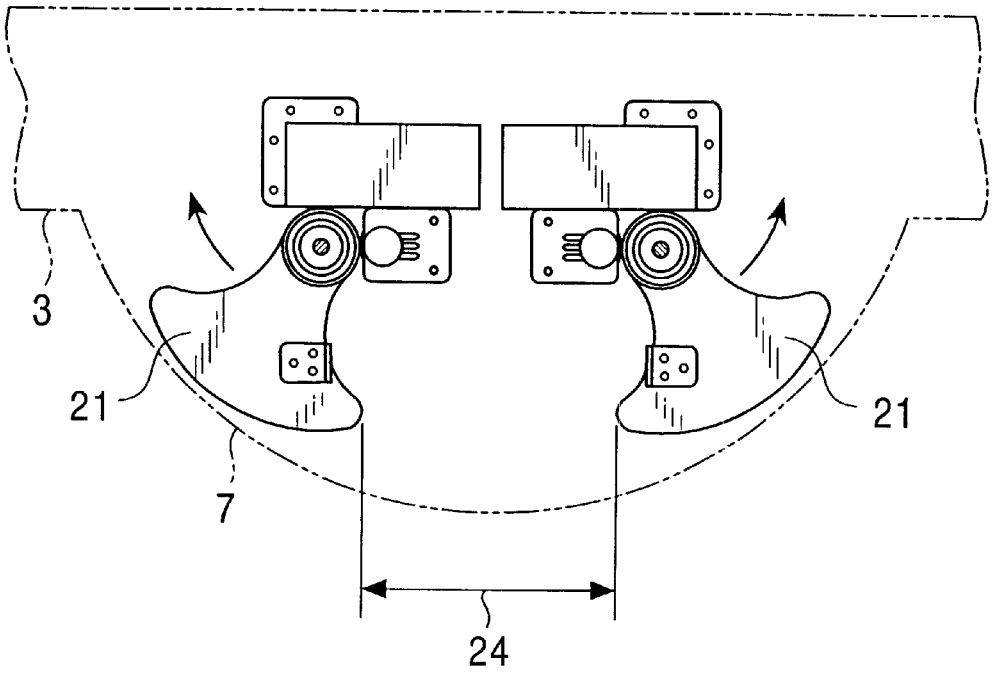
FIG. 9 is a view of the goal in a completely shut state.

With the above configuration, driving power transferred from the driving motor 22 to the gearbox 23 is transmitted via a driving gear 23*a* to a driven gear 21*a* fitted to the blocking member 21. Thereby, the blocking member 21 is allowed to be gradually rotationally displaced from a fully open position shown in FIG. 7 to a semi-open position shown in FIG. 8, and to a completely-shut position shown in FIG. 9.

With the blocking member 21 in the fully open position, an opening 24 provided in the goal 7 becomes in the fully open, in which state scoring is easiest. In contrast, with the blocking member 21 in the semi-open position, the opening 24 is formed slightly larger than the puck (not shown) in a central portion of the goal 7, thereby causing scoring to be the most difficult. With the blocking member 21 in the completely-shut position, the size of the opening 24 may be set such that the puck cannot enter the goal 7.

The supporting bracket 45 has angle detectors 25 and transmission gears 26. Each of the angle detectors 25 is made of a rotational variable resistor. Each of the transmission gear 26 engages with the driven gear 21*a*, and is rotationally driven according to the rotational displacement of the blocking member 21. The rotational angle of the blocking member 21 is detected by the angle detector 25. Also, stoppers are provided, each consisting of a rotation-stopping plate 27 mounted on an upper surface of the blocking member 21 and a pair of engaging pins (not shown) provided on the supporting bracket 45 so as to protrude. Also, each of the stoppers restricts the rotational range of the blocking member 21, thereby preventing the blocking member 21 from rotating beyond the range between the fully open position and the completely-shut position of the goal 7.

The described air hockey game apparatus has a control unit 34 (controller unit) for outputting control signals to the air-blower 13, thereby controlling the air-blowing condition. The control unit 34 has a handicap-mode controller 32 and a roulette-mode controller 33. The handicap-mode controller 32 controls a handicap mode that differentiates the open sizes of the goals according to a signal inputted via operating selection buttons 31 (input unit). The handicap-mode controller 32 allows the roulette displays 19 to operate according to movement of the puck, and in addition, controls the roulette mode that changes the open sizes of the goals 7 according to results of operation of the roulette displays 19.

The respective selection buttons 31 are, as shown in FIG. 2, a push button for selecting the handicap mode and a push button for selecting the roulette mode. Before the game is started, a user input operations using the selection buttons 31 to set a game mode. For the selection buttons 31, a push button for selecting a normal mode may be provided which is used for playing the air hockey game in a normal mode.

The handicap-mode controller 32 is arranged as described in the following paragraphs.

When the handicap mode is selected according to operations of the selection buttons 31, the handicap-mode controller 32 outputs a control signal to the driving motor 22 that drives the blocking members 21, thereby fully opening the goal 7 provided at the end of the puck sliding surface 2. The abovementioned end is assumed to be the end of a first game player. Concurrently, the handicap-mode controller 32 drives the goal 7 provided at the other end of the puck sliding surface 2 to the completely shut condition. The abovementioned end is assumed to be the end of a second game player. In this way, the game is started.

During the game, when a score is recognized according to a detection signal outputted from the goal sensor 35 which is formed made of the passing sensor, the handicap-mode controller 32 outputs a control signal to the driving motor 22. The control signal changes the open sizes of the goals 7 so that game players can play a game which is suitably adjusted to the difference in skill of the game players. Concurrently, the handicap-mode controller 32 outputs control signals to configuration members, such as the score displays 8, the audio unit 9, the luminophors 16, and the roulette displays 19.

The roulette-mode controller 33 drives the two goals 7 to the completely shut state when the game is started. When movement of the puck is detected by the puck detectors 17, the roulette-mode controller 33 drives the roulette displays 19 to change digital displays. Then, the roulette-mode controller outputs a control signal that drives the goal 7 at the end of the opposing game player to the fully open state, thereby changing the game mode to a chance mode. Concurrently, the roulette-mode controller 33 outputs control signals to other members, such as the audio unit 9, the luminophors 16, and the roulette displays 19, thereby allowing a predetermined performance to be executed.

Figure 11:
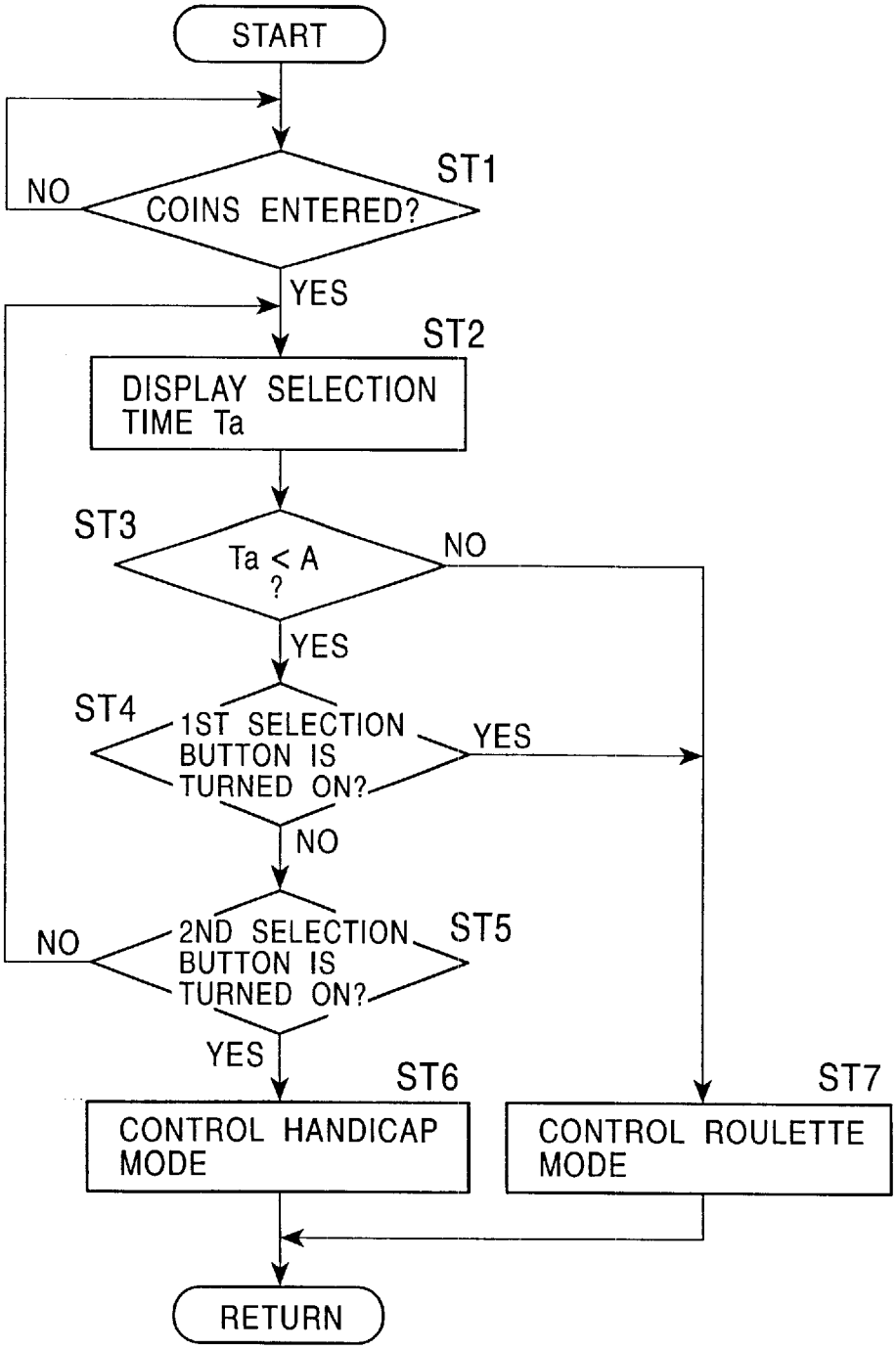
FIG. 11 is a flowchart of the basic control processing.

Hereinbelow, with reference to a flowchart in FIG. 11, a description will be given of basic control processing to be executed by the control unit 34.

When the basic control processing is started, step ST1 determines if coins are entered in a coin-entry opening provided at a predetermined position of the air hockey game apparatus. If step ST1 determines the condition to be YES, processing control is passed to step ST2. Step ST2 commands the score display 8 and the roulette displays 19 to individually display a selection time Ta for allowing a game mode to be selected.

Subsequently, step ST3 determines if the selection time Ta is less than a reference time A preset to approximately 30 seconds. If the step ST3 determines the condition to be YES, processing control is passed to step ST4. Step ST4 determines if a first selection button for selecting the handicap mode is turned ON. If step ST4 determines the condition to be NO, processing control is passed to step ST5. Step ST5 determines if a second selection button for selecting the roulette mode is turned ON. If step ST5 determines the condition to be YES, processing control is passed to step ST6. Step ST6 controls the handicap mode described below.

If step ST3 determines the condition to be NO, verifying that the time elapses past the reference time A while neither of the first and second selection buttons is turned ON, step ST7 controls the roulette mode. Step ST7 also controls the roulette mode if step ST4 determines the condition to be YES, verifying that the second selection button is turned ON.

Figure 12:
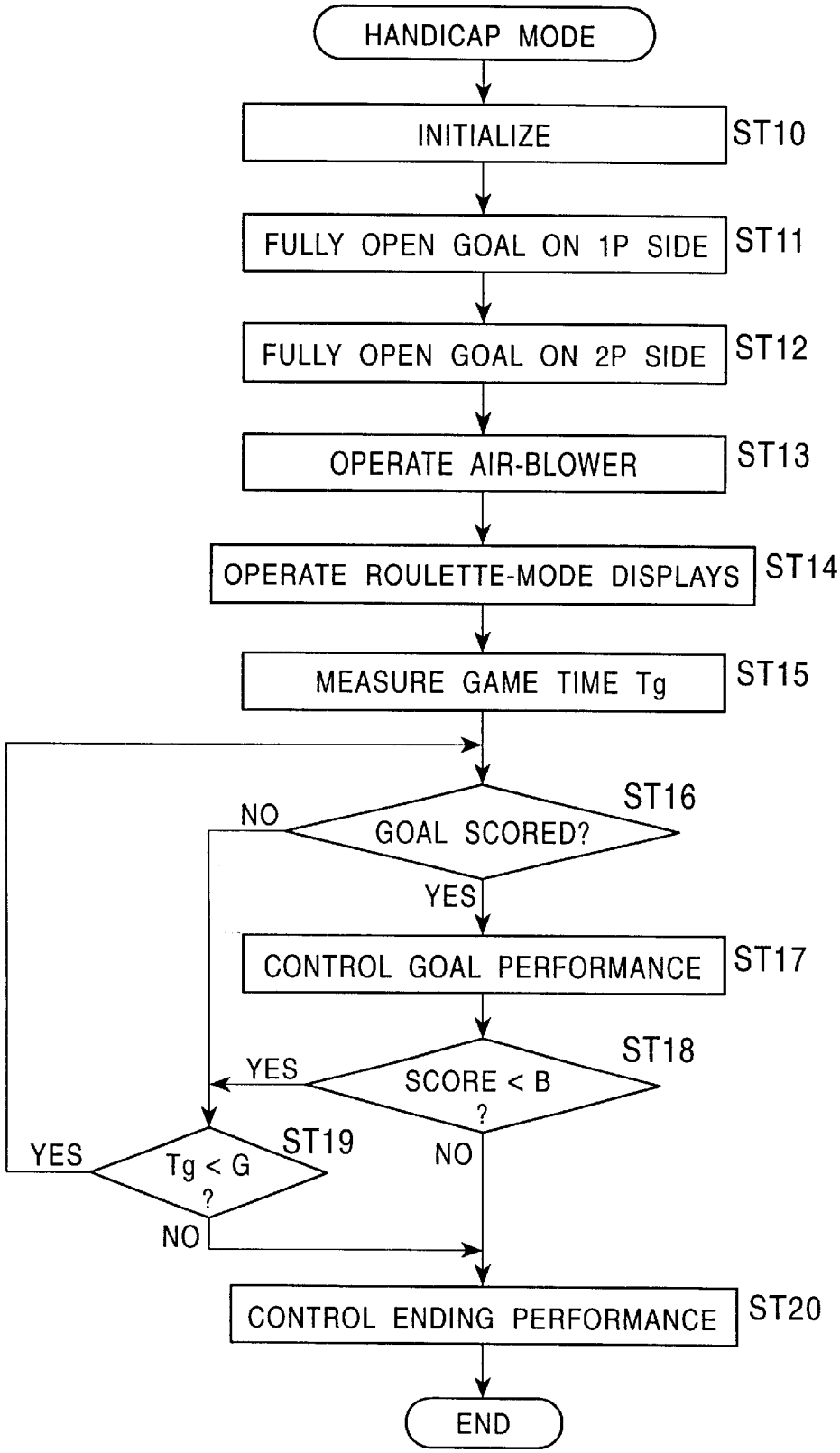
FIG. 12 is a flowchart of control processing in a handicap mode.

Hereinbelow, with reference to a flowchart in FIG. 12, control processing in the handicap mode is described.

Upon starting the control processing, step ST10 performs initialization, resetting various existing values, such as control values. Then, step ST11 causes the goal 7 at the end of a first game player IP to be in the fully open state. Subsequently, step ST12 outputs a control signal that drives the goal 7 at the end of a second game player 2P to the completely shut state with an opening/closing driving unit of the driving motor 22.

In step ST13, the air-blower 13 starts blowing air toward the air-communicating openings of the puck sliding surface 2. In step ST14, the roulette displays 19 change numbers digitally displayed. In step ST15, a game time Tg is measured. Subsequently, according to a detection signal outputted by the goal sensor 35, step ST16 determines if one of the first and second game players 1P and 2P has scored a goal. If step ST16 determines the condition to be YES, processing control is passed to step ST17. ST17 controls a goal performance described below. Subsequently, step ST18 determines if the score is lower than a predetermined final score B.

If step ST16 determines the condition to be NO, verifying that no goal has been scored, processing control is passed to step ST19. Step ST19 determines if the game time Tg is less than a predetermined termination time G. Step ST19 also determines the same condition as above if step ST18 determines the condition to be YES, verifying that the score is lower than the predetermined final score B. If step ST19 determines the condition to be YES, it returns processing control to step ST16 so that the described control processing is repeated.

If step ST18 determines the condition to be NO, verifying that the goal score gained by one of the first and second game players 1P and 2P is higher than the final score B, processing control is passed to step ST20. Step ST20 controls an ending performance, and then terminates the control processing. Step ST20 is also performed if step ST19 determines the condition to be NO, verifying that the game time Tg is greater than the termination time G.

Figure 13:
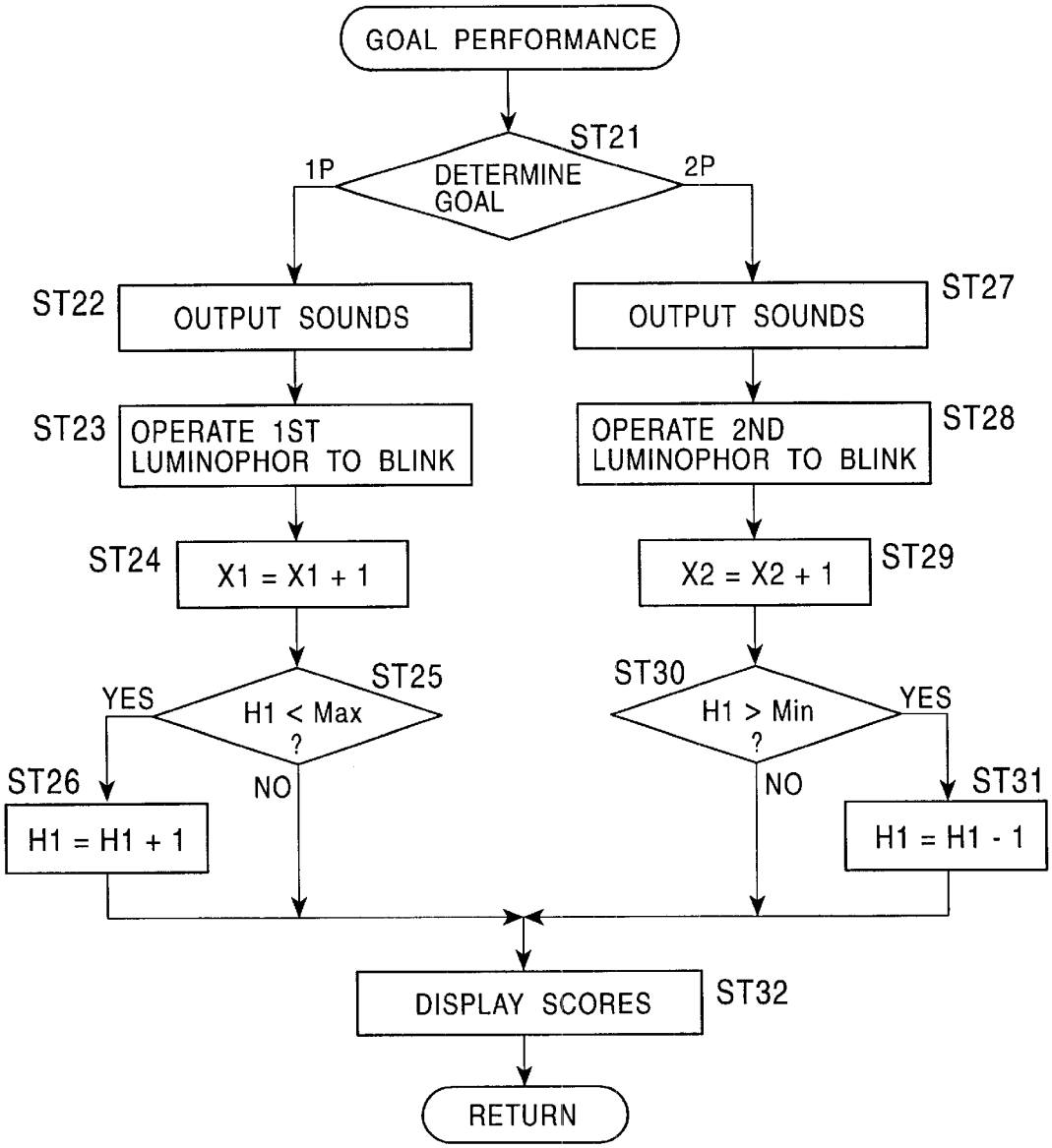
FIG. 13 is a flowchart of control processing in goal performance.

Hereinbelow, with reference to a flowchart in FIG. 13, a description will be given of control processing in the goal performance executed in step ST17 in the handicap mode.

Upon starting the control processing, step ST21 determines which one of the first and second game players 1P and 2P has scored the goal. As a result of the determination in step ST21, if the goal score is verified to have been gained by the first game player 1P, step ST22 commands the audio unit 9 to output predetermined sounds, and also, step ST23 commands a first luminophor to blink. The first luminophor is made of light-emitting diodes arranged in the peripheral wall section 3 at the end of the first game player 1P.

Also, step ST24 adds "1" to a score X1 gained by the first game player IP and displays it on the score displays 8. Then, step ST25 determines if the open size of the goal 7 at the end of the first game player 1P is smaller than in the fully open state, that is, if a handicap H1 of the first game player IP is smaller than a maximum value Max. If step ST25 determines the condition to be YES, processing control is passed to step ST26. Step ST26 adds "1" to the handicap H1, thereby increasing the open size of the goal 7 on the side of the first game player 1P by one step. This results in an increase in scoring capacity for the second game player 2P.

As a result of the determination in step ST21, if the goal score is verified to have been gained by the first game player 2P, step ST27 commands the audio unit 9 to output predetermined sounds, and also, step ST23 commands a second luminophor to blink. The second luminophor is made of light-emitting diodes arranged in the peripheral wall section 3 at the end of the second game player 2P.

Also, step ST29 adds "1" to a score X2 gained by the second game player 2P and displays it on the score displays 8. Then, step ST30 determines if the open size of the goal 7 at the end of the first game player 1P is greater than that in the completely shut condition, that is, if a handicap H1 of the first game player IP is greater than a minimum value Min. If step ST30 determines the condition to be YES, processing control is passed to step ST31. Step ST31 subtracts "1" from the handicap H1, thereby reducing the open size of the goal 7 at the end of the first game player 1P by one step. This results in a decrease in scoring capacity for the second game player 2P. Subsequently, step ST32 displays scores gained by the first and second game players 1P and 2P on the score displays 8 and the roulette displays 19, and thereafter, processing control is returned so as to perform control for the handicap mode shown in FIG. 12.

Figure 14:
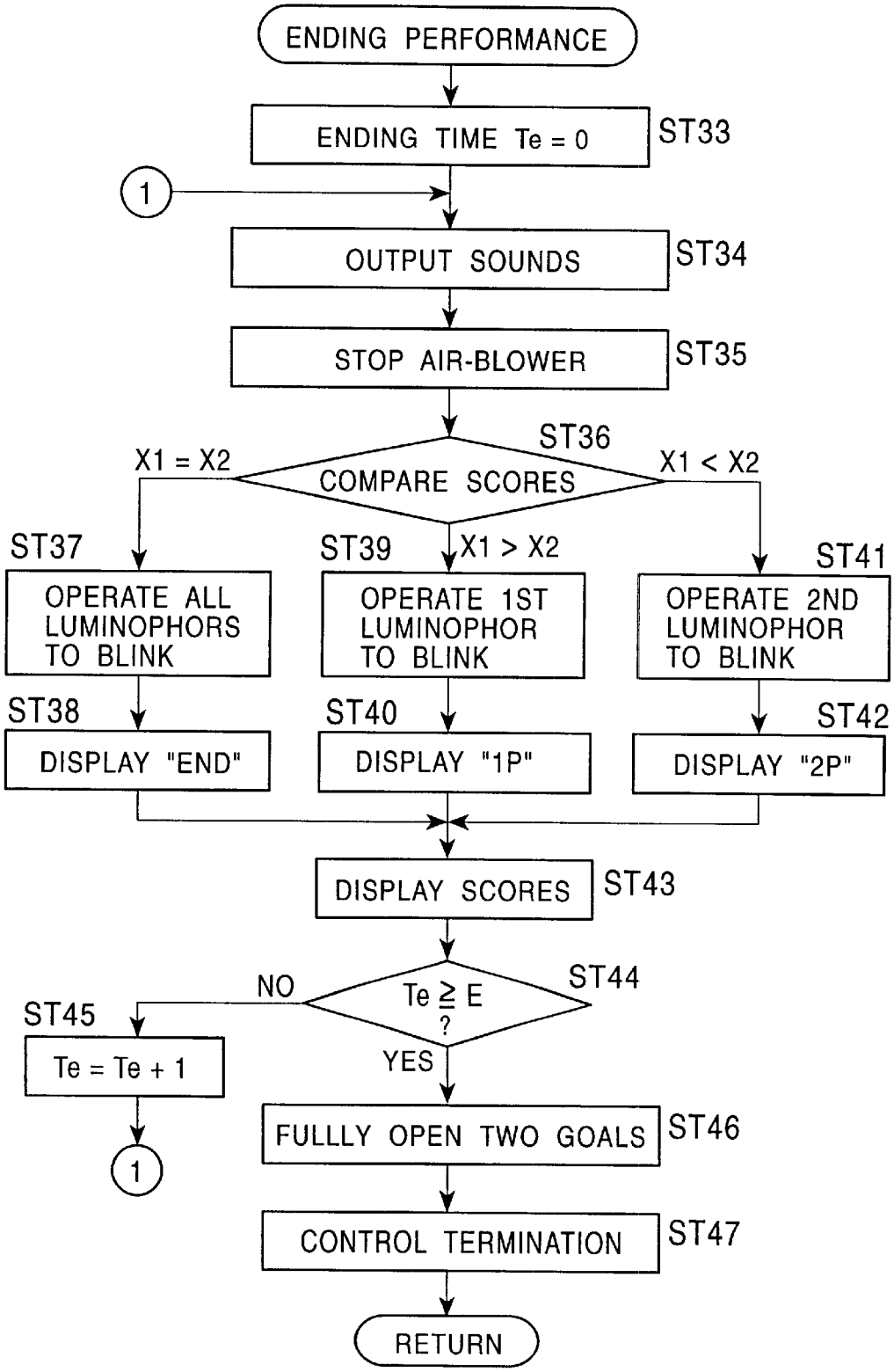
FIG. 14 is a flowchart of control processing in ending performance.

Hereinbelow, with reference to a flowchart in FIG. 14, a description will be given of control processing in the ending performance executed in step ST20 in the handicap mode.

Upon starting the control processing, step ST33 resets an ending time Te to zero, step ST34 commands the audio unit 9 to output sounds, and step ST35 stops the air-blower 13 to terminate air-blowing. Subsequently, step ST36 compares a score X1 gained by the first game player 1P and a score X2 gained by the second game player 2P upon completion of the game. If step ST36 verifies the two scores X1 and X2 to be the same, processing control is passed to steps ST37, and then to ST38. Step ST37 commands all the luminophors provided in the peripheral wall section 3 to blink. Step ST38 commands the individual roulette displays 19 to display "END".

If step ST36 verifies that the score X1 gained by the first game player 1P is higher than the score X2 gained by the second game player 2P, that is, the first game player 1P has won the game, processing control is passed to step ST39. ST39 commands the first luminophor at the end of the first game player 1P to blink. Subsequently, step ST40 commands the roulette displays 19 to display "1P" and the like.

If step ST36 verifies that the score X1 gained by the first game player 1P is lower than the score X2 gained by the second game player 2P, that is, the second game player 2P has won the game, processing control is passed to step ST41. Step ST41 commands the second luminophor at the end of the second game player 2P to blink. Subsequently, processing control is passed to step ST42 that commands the roulette displays 19 to display "2P" and the like.

Subsequently, step ST43 commands the score displays 8 to display the respective scores X1 and X2 gained by the first and second players P1 and P2. Step ST44 determines if the ending time Te exceeds a predetermined reference time E. If step ST44 determines the condition to be NO, processing control is passed to ST45. Step ST45 adds "1" to the ending time Te and returns processing control to step ST34 so that the control processing is repeated.

If step ST44 determines the condition to be YES, processing control is passed to step ST46. In step ST46, a control signal for driving the two goals 7 to be in the fully open state is outputted to the driving motor 22. Subsequently, step ST47 executes termination control including tasks for turning off all the individual displays and so forth, then returns processing control, thereby terminating the control processing.

Figure 15:
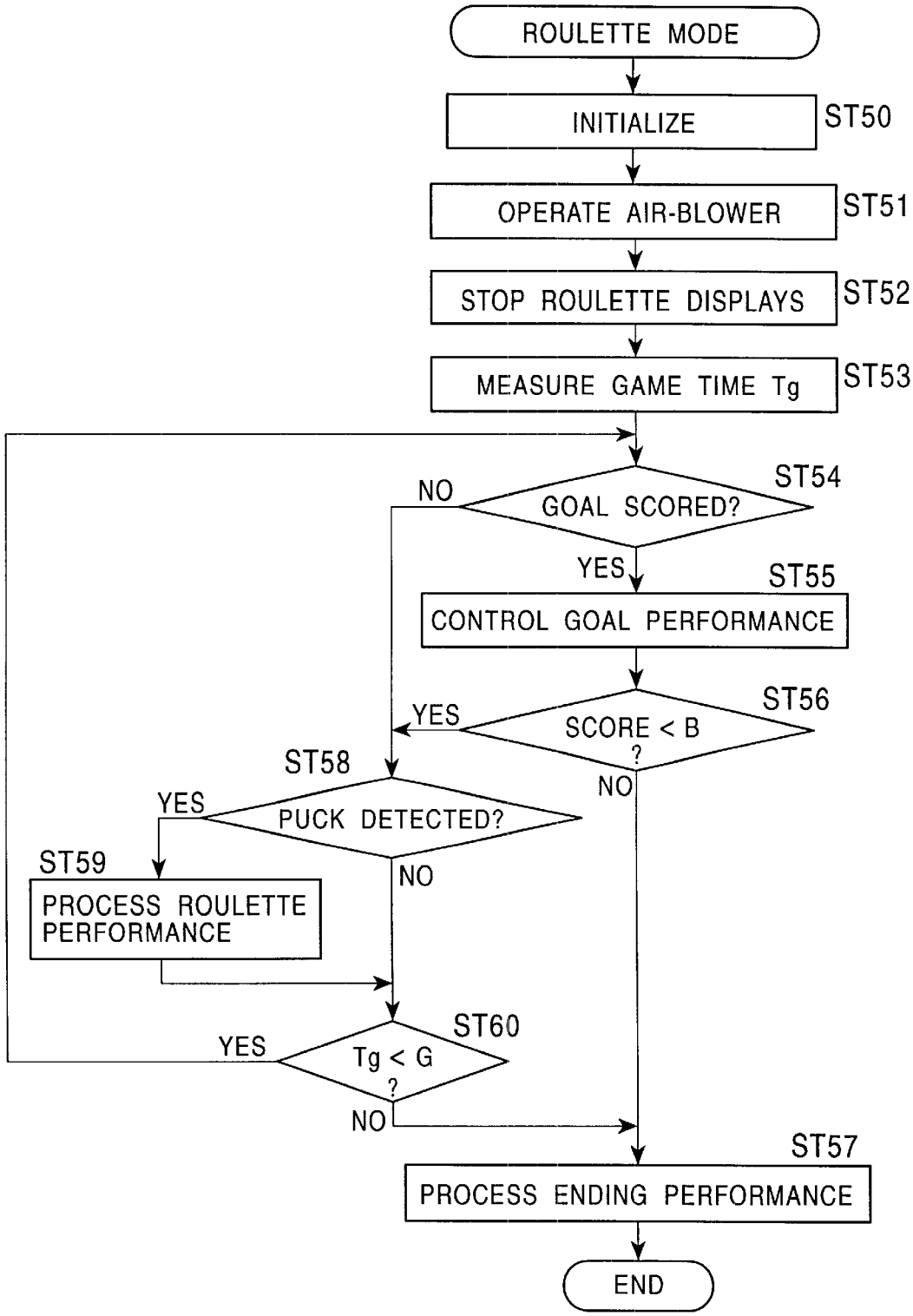
FIG. 15 is a flowchart of control processing in a roulette mode.

Hereinbelow, with reference to a flowchart in FIG. 15, a description will be given of control processing in the roulette mode.

Upon starting the control processing, step ST50 performs initialization, resetting various existing control values and commanding the two goals 7 to be in the completely shut condition. Subsequently, step ST51 commands the air-blower 13 to blow air toward air-communicating openings of the puck sliding surface 2, and step ST52 stops the roulette displays 19. Then, step ST53 starts measurement of the game time Tg.

Subsequently, step ST54 determines if one of the first and second game players 1P and 2P has scored a goal according to a detection signal outputted by the goal sensor 35. If step ST54 determines the condition to be YES, processing control is passed to step ST55. Step ST55 controls the goal performance. Thus, the control processing in the goal performance in the roulette mode is the same as the control processing in the handicap mode except for the following. The control processing in the roulette mode does not include a determination of and the changing operations for the handicap H1 which are performed in steps ST25, ST26, ST30, and ST31 in FIG. 13.

Step ST56 determines if the score is lower than a predetermined final score B. If step ST56 determines the condition to be NO, verifying that the score gained by one of the first and second game players 1P and 2P is higher than the final score B, processing control is passed to step ST57. Step ST57 performs the ending performance shown in FIG. 14, then the control processing terminates.

If step ST54 determines the condition to be NO, verifying that no goals are scored, processing control is passed to step ST58. Step ST58 determines if the puck detectors 17 have detected passage of the puck. Step ST58 is also performed if step ST56 determines the condition to be YES, verifying that the score is lower than the final score B.

If step ST58 determines the condition to be YES, processing control is passed to step ST59. Step ST59 performs control for the roulette performance, and passes processing control to step ST60. Step ST60 determines if the game time Tg is less than a predetermined termination time G. If step ST60 determines the condition to be YES, verifying that the game time Tg is greater than the termination time G, processing control is passed to step ST57, and the control processing terminates.

Figure 16:
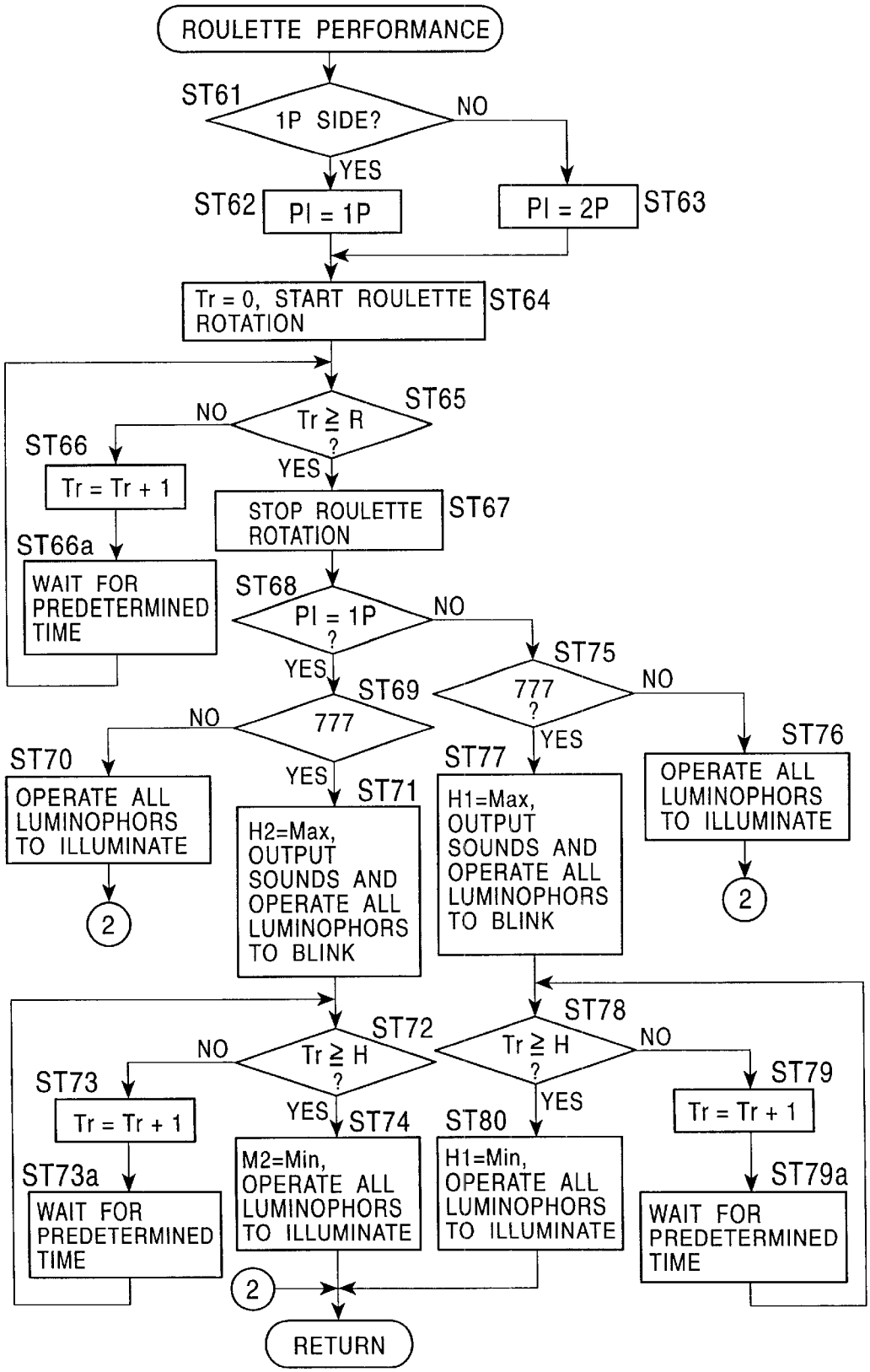
FIG. 16 is a flowchart of control processing in roulette performance.

Hereinbelow, with reference to a flowchart in FIG. 16, a description will be given of control processing in roulette performance performed in step ST59 described above.

Upon starting the operation control, step ST61 determines if the puck detector 17 have detected the puck hit by the first game player IP. Specifically, step ST61 determines the direction in which the puck passes according to the order in which detection signals are outputted by the puck detector 17 made of the four light-sensitive detectors provided around the large openings 14. According to the direction determined, step ST61 performs the determination described above.

If step ST61 determines the condition to be YES, verifying that the puck detector 17 has detected the puck hit by the first game player IP, processing control is passed to step ST62. Step ST62 sets a flag P1 for identifying that game player is set to "1P". On the other hand, if step ST61 determines the condition to be NO, verifying that the puck detector 17 has detected the puck hit by the second game player 2P, processing control is passed to step ST63. Step ST63 sets the flag P1 for identifying the game player to "2P".

Subsequently, step ST64 resets an execution time Tr for roulette performance to zero, commands the roulette displays 19 to operate, and passes processing control to step ST65. Step ST65 determines if the execution time Tr is the same as or greater than a predetermined reference time R. If step ST65 determines the condition to be NO, processing control is passed to step ST66. Step ST66 adds "1" to the execution time Tr and passes processing control to step ST66*a* that awaits an input for a predetermined period of time and returns processing control to step ST65.

If step ST65 determines the condition to be YES, verifying the execution time Tr is the same as or greater than the predetermined reference time R, it passes processing control to step ST67, then to step ST68. Step ST67 commands the roulette displays 19 to stop, and subsequently, step ST68 determines if the flag P1 is set to "1P". If step ST68 determines the condition to be YES, verifying that the flag P1 is set to "P1", processing control is passed to step ST69. Step ST69 determines if the roulette displays 19 display the digits "777". If step ST69 determines the condition to be NO, verifying that the roulette displays 19 display digits other than the digits "777", processing control is passed to step ST70. Step ST70 turns on all the luminophors 16 to illuminate, and returns processing control to the control processing in the roulette mode shown in FIG. 15.

If step ST69 determines the condition to be YES, verifying that the roulette displays 19 display the digits "777", processing control is passed to step ST71. Step ST71 sets a handicap H2 for the second game player 2P to the maximum value Max and causes the open size of the goal 7 at the end of the second game player 2P to be in the fully open state. Also, step ST71 commands the audio unit 9 to output predetermined sounds and commands all the luminophors 16 to blink.

Subsequently, step ST72 determines if the execution time Tr for the roulette performance is the same as or greater than a termination time H for the chance mode. If step ST72 determines the condition to be NO, processing control is passed to step ST73. Step ST73 adds "1" to the execution time Tr, then passes processing control to step ST73*a* that awaits for a predetermined period of time for an input and returns processing control to step ST72.

If step ST72 determines the condition to be YES, verifying that the execution time Tr for the roulette mode matches or exceeds the termination time H for the chance mode, processing control is passed to step ST74. Step ST74 sets the handicap H2 for the second game player 2P to the minimum value Min and returns the open size of the goal 7 at the end of the second game player 2P to the completely shut state and turns on all the luminophors 16. Then, step ST74 returns processing control to the control processing in the roulette mode shown in FIG. 15.

If step ST68 determines the condition to be NO, verifying that the flag P1 is set to "2P", step ST75 determines if the roulette displays 19 display the digits "777". If step ST75 determines the condition to be NO, verifying that the roulette displays 19 display digits other than the digits "777", processing control is passed to step ST76. Step ST76 turns on all the luminophors 16 to illuminate and returns processing control to the control processing in the roulette mode shown in FIG. 15.

If step ST75 determines the condition to be YES, verifying that the roulette displays 19 display the digits "777", processing control is passed to step ST77. Step ST77 sets the handicap HI for the first game player 1P to the maximum value Max and causes the open size of the goal 7 at the end of the first game player 1P to be in the fully open state. Also, step ST77 commands the audio unit means 9 to output predetermined sounds and commands all the luminophors 16 to blink.

Subsequently, step ST78 determines if the execution time Tr for the roulette mode is the same as or greater than the termination time H set for chance mode. If step ST78 determines the condition to be NO, processing control is passed to step ST79. Step ST79 adds "1" to the execution time Tr, and subsequently, step ST79*a* awaits an input and returns processing control to step ST78.

If step ST78 determines the condition to be YES, verifying that the execution time Tr for the roulette performance is the same as or greater than the termination time H set for the chance mode, processing control is passed to step ST80. Step ST80 sets the handicap H1 for the first game player 1P to the minimum value Min and returns the open size of the goal 7 at the end of the first game player 1P to the completely shut state. Also, step ST80 turns on all the luminophors 16 to illuminate, and returns processing control to the roulette mode shown in FIG. 15.

As described above, the air hockey game apparatus has the puck sliding surface 2 having blowholes 40 for air for floating the puck, the air-blower 13 for transferring air into the blowholes 40, the peripheral wall section 3 as the puck-reflecting frame around the puck sliding surface 2, and the goals 7 on the puck sliding surface 2, thereby allowing competition for entering the puck into the goals 7. In this air hockey game apparatus, there are also provided the blocking members 21 in the goals 7; the opening/closing driving unit consisting of the driving motor 22, the gearbox 23, and the like, for changing the open sizes of the goals 7 by using the blocking members 21; and the controller made of the control unit 34 for controlling the driving motors 22. According to this configuration, for example, the blocking members 21 are driven by the opening/closing driving unit to correspond to a scoring status and movement of the puck, and the open sizes of the goals are changed by the blocking members, thereby providing dynamic characteristics to the game which are unforeseeable by the game players. This allows amusement characteristics to be improved.

Particularly remarkable is that the control unit 34 controls operational conditions of the driving motors 22, and the blocking members are thereby arranged to be rotationally displaced to gradually change the open sizes of the goals 7 so as to correspond to the scoring status and movement of the puck. Therefore, amusement characteristics of the game can be improved even more effectively.

For each of the opening/closing driving units, an air-cylinder, a push-pull solenoid, or the like may be used. Using the abovementioned component is advantageous in that the rotational position can be easily and precisely set when, as in the described invention, the opening/closing driving unit is configured of the driving motor 22, the gearbox 23, and the like.

Also, in the described invention, each of the blocking members is rotatably supported by the vertical supporting axis 20, has a blocking face spreading in an arcuate shape with the vertical axis in the center, and is rotationally displaced according to driving force of the driving motor 22, the driving force being transmitted by the power transmission mechanism consisting of the gearbox 23 and the like. In this arrangement, the open angles of the goals 7 can be changed easily and safely corresponding to the rotational position of the blocking members 21 that are rotationally displaced with the vertical axis in the center.

Also, in the described embodiment, when the handicap mode is selected according to the input signal of the inputting means made from the selection buttons 31, made of the pair of push buttons or the like which the game players operate before start of the game, the operational conditions of the blocking members are controlled to change the open sizes of the goals 7, thereby preliminarily providing handicaps depending on the difference in skills of the game players. This makes the game to be played for fair and strong competition, thereby allowing effective improvement in amusement characteristics to be achieved.

Also, amusement characteristics of the game can be improved even more effectively in an arrangement in which operational conditions of the blocking members 21 are controlled corresponding to the game status, thereby changing the open angle of the goals 7. For example, as in the described embodiment, the open sizes of the goals 7 are changed gradually corresponding to scores gained by the game players so that one of the game players who has gained a higher score is placed in a disadvantageous position. This makes the game to be played for fair and strong competition, thereby allowing effective improvement in amusement characteristics to be achieved.

Also, in the described embodiment, the description has been given of the arrangement in which only the open angle of the goal 7 at the end of the first game player 1P according to scores gained by the first and second game players 1P and 2P in control in the handicap mode. However, there are no restrictions to the above. In this regard, an arrangement may be such that the open angle of the goal 7 at the end of the second game player 2P is changed, or the open angles of the goals 7 at the ends of both the first and second game players 1P and 2P are changed.

Also, the described invention may be arranged such that the status determination unit determines the game status according to scores of the air hockey game. According to this arrangement, the open sizes are changed so that, for example, one of the game players who achieved a high score is placed in a disadvantageous position depending on the scores of the air hockey game. This allows the game to be played for fair competition, thereby allowing effective improvement in amusement characteristics to be achieved.

In the described embodiment, the reacting unit made of the roulette displays 19 is provided. The reacting unit reacts to movement of the puck in control in the roulette mode, thereby controlling the operational conditions of the blocking member 21 according to results of reaction by the reacting unit so as to change the open angles of the goals 7. In this case, since the roulette displays 19 display digits unforeseeable to the game players, dynamic characteristics of the game can be effectively improved. Specifically, when movement of the puck is detected by the puck detector 17 provided in the central portion of the puck sliding surface 2, and digits displayed on the roulette displays 19 are changed so that specific digits, such as the digits "777", are displayed, the goal 7 at the opponent end is driven to be in the fully open state. By this, the chance mode which is advantageous to one of the game players 1P and 2P is set. This allows effective improvement to be achieved for characteristics for exciting game players.

Although the described embodiment has the pair of goals on the puck sliding surface 2, there are no restrictions to it. For example, only one of the single goals 7 may be provided to allow a single game player to enjoy the game. However, with the pair of goals 7 provided on the puck sliding surface 2 as in the case of the described embodiment, two game players can enjoy match games that allow competition for scores.

Also, the described embodiment has the pair of goals 7 at the front and rear ends of the puck sliding surface 2. As an alternative arrangement, however, three or more goals may be provided. Also, another alternative arrangements may be such that the pair of goals 7 is provided at two ends of a puck sliding surface 2 having a U shape or a V shape, in which the puck hit by game players enters into the goal 7 at the opposing end side via U-shaped portions or V-shaped portions.

Also, the open angles of the goals 7 to be opened or shut may be displayed in either the roulette displays 19 or the score displays 8. Alternatively, a different displaying unit may be provided to display the open angles of the goals 7. This arrangement effectively allows the game players to recognize the open angles of the goals 7 which are changed according to results of reaction by the reaction unit made of the roulette displays 19, thereby allowing amusement characteristics of the game to be improved even more effectively.

Also, instead of the puck detector 17 made of light-sensitive detectors, sensors such as impact sensors, pushing sensors, contact sensors, light-reflection sensors, or the like may be used. Also, if a puck made of a magnetic material is used, the puck detector 17 may be made of a magnetic sensor.

Also, in the described embodiment, when movement of the puck is detected by the puck detector 17 made of the light-sensitive detectors provided in the central portion of the puck sliding surface 2, digits displayed on the roulette displays 19 are changed. An alternative arrangement for the above may be such that the roulette displays 19 are operated to change the digits displayed on the roulette displays 19 when movement of the puck or goal motion is detected either by the puck detectors 17, which are made of the light-sensitive detectors and the like provided around the peripheral wall section 3 to be used as the reflecting frame of the puck, or the goal sensors 35 provided in the goals 7.

Also, the blowholes 40 formed on the puck sliding surface 2 need not be arranged at uniform pitches, but may be arranged at smaller pitches depending on the areas, thereby providing areas with high densities of the blowholes 40. For example, areas with a high density of the blowholes 40 may be provided at two sides of the goal 7 so that the puck is easily induced into the goal 7. Alternatively, for example, areas with a high density of the blowholes 40 may be provided in the vicinity of the puck detectors 17 made of light-sensitive detectors provided in the central portions of the puck sliding surface 2 so that the puck is induced to approach portions where the puck detectors 17 are installed.

Also, an arrangement may be such that irregularly reflecting areas with, for example, concave portions, notches, convex portions, and openings are provided so that the puck irregularly bounces. This arrangement allows dynamic characteristics of the game to be improved even more effectively.

Figure 17:
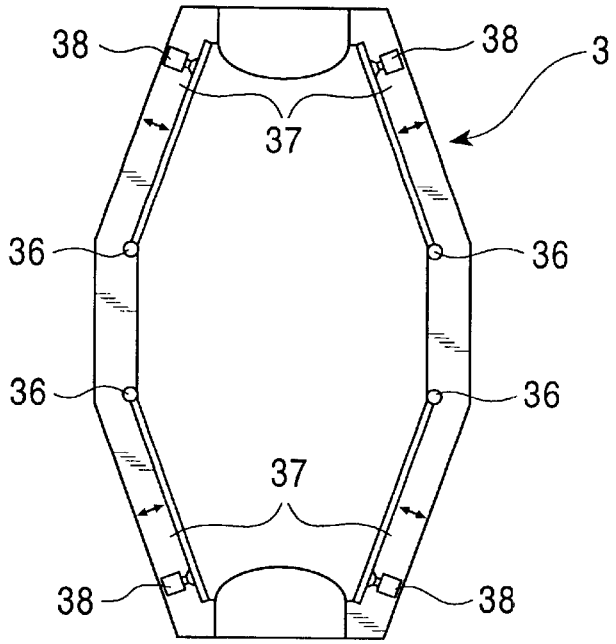
FIG. 17 is a view of a different embodiment of the air hockey game apparatus according to the present invention.

Also, as shown in FIG. 17, an arrangement may be such that reflecting boards 37 and driving units 38 are provided, wherein the reflecting boards 37 vibrate with the support of vibrating axes 36, and the driving units 38 are made of a driving cylinder or a push-pull solenoid that cause the reflecting boards 37 to vibrate. Also, the driving units 38 are operated according to the game status, and installation angles of the reflecting boards are changed, thereby allowing goal-scoring to be easy or difficult. This arrangement also provides dynamic characteristics to the game.

Figure 18:
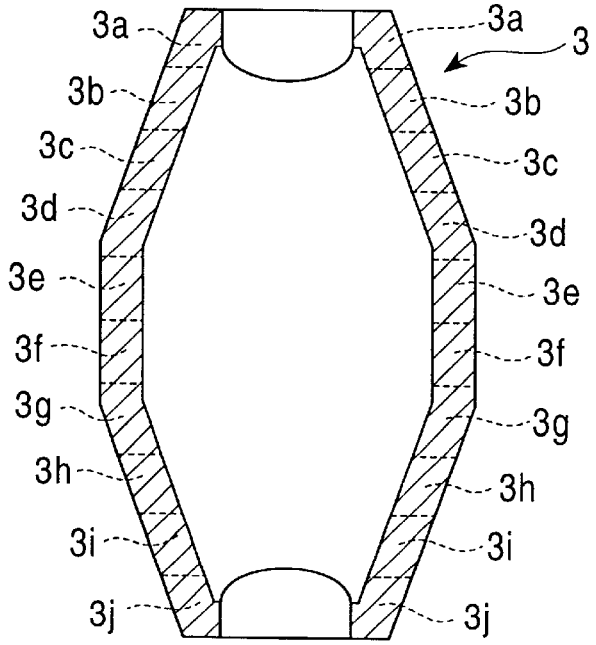
FIG. 18 is a view of a different embodiment of the air hockey game apparatus according to the present invention.

Also, as shown in FIG. 18, an arrangement may be such that the peripheral wall section 3 positioned at the left and right lateral sides is partitioned in multiple blocks 3*a* to 3*j*, luminophor which illuminates in two different colors corresponding to the two game players in the blocks 3*a* to 3*j* are individually provided, and the illumination color is changed corresponding to scores or the like that the game players obtain. In this configuration, since the illumination color of the blocks 3*a* to 3*j* changes corresponding to the difference in scores, an advantage can be provided in that the game-scoring status can be recognized even more quickly.

As above, while the present invention has been described with reference to what are presently considered to be the preferred embodiment, it is to be understood that the invention is not limited to the described embodiment and modifications. On the contrary, the invention is intended to cover various other modifications and equivalent arrangements included within the spirit and scope of the invention.

What is claimed is:

1. An air hockey game apparatus comprising:

a puck sliding surface having blowholes for blowing air to float a puck, air-blowing means for blowing and sending air toward blowholes, a puck-reflecting frame around the puck sliding surface, goals on the puck sliding surface, blocking members in the goals, opening/closing driving means for changing the open sizes of the goals by using the blocking members, and control means for controlling the opening/closing driving means, thereby allowing competition for entering the puck into the goals.

2. An air hockey game apparatus as claimed in claim 1, wherein the control means controls operational conditions of the blocking members so as to gradually change the open sizes of the goals.

3. An air hockey game apparatus as claimed in one of claims 1 and 2, wherein each of the opening/closing driving means comprises a driving motor and a power transmission mechanism for transmitting power of the driving motor to the blocking member.

4. An air hockey game apparatus as claimed in claim 3, wherein each of the blocking members is rotatably supported with a vertical axis in the center, has a blocking face spreading in an arcuate shape with the vertical axis in the center, and is rotationally displaced according to driving force of the driving motor which is transmitted by the power transmission mechanism.

5. An air hockey game apparatus as claimed in claim 4, further comprising inputting means for inputting and specifying the open sizes of the goals, wherein the control means controls the operational conditions of the blocking members to change the open sizes of the goals according to input signals of the inputting means.

6. An air hockey game apparatus as claimed in claim 5, wherein a pair of goals is provided on the puck sliding surface so as to oppose each other.

7. An air hockey game apparatus as claimed in claim 6, further comprising displaying means for displaying the open sizes of the goals opened or shut by the blocking means.

8. An air hockey game apparatus as claimed in claim 5, further comprising displaying means for displaying the open sizes of the goals opened or shut by the blocking means.

9. An air hockey game apparatus as claimed in claim 4, further comprising status determination means for determining the game status, wherein the control means controls the operational conditions of the blocking members to change the open sizes of the goals according to the game status determined by the status determination means.

10. An air hockey game apparatus as claimed in claim 9, wherein the game status determined by the status determination means is represented by scores of the air hockey game.

11. An air hockey game apparatus as claimed in claim 10, wherein a pair of goals is provided on the puck sliding surface so as to oppose each other.

12. An air hockey game apparatus as claimed in claim 11, further comprising displaying means for displaying the open sizes of the goals opened or shut by the blocking means.

13. An air hockey game apparatus as claimed in claim 10, further comprising displaying means for displaying the open sizes of the goals opened or shut by the blocking means.

14. An air hockey game apparatus as claimed in claim 9, wherein a pair of goals is provided on the puck sliding surface so as to oppose each other.

15. An air hockey game apparatus as claimed in claim 14, further comprising displaying means for displaying the open sizes of the goals opened or shut by the blocking means.

16. An air hockey game apparatus as claimed in claim 9, further comprising displaying means for displaying the open sizes of the goals opened or shut by the blocking means.

17. An air hockey game apparatus as claimed in claim 4, further comprising reacting means for reacting to movement of the puck, and the control means controls the drive condition of the blocking means to change the open size of the goals.

18. An air hockey game apparatus as claimed in claim 17, wherein a pair of goals is provided on the puck sliding surface so as to oppose each other.

19. An air hockey game apparatus as claimed in claim 18, further comprising displaying means for displaying the open sizes of the goals opened or shut by the blocking means.

20. An air hockey game apparatus as claimed in claim 17, further comprising displaying means for displaying the open sizes of the goals opened or shut by the blocking means.

21. An air hockey game apparatus as claimed in claim 4, wherein a pair of goals is provided on the puck sliding surface so as to oppose each other.

22. An air hockey game apparatus as claimed in claim 21, further comprising displaying means for displaying the open sizes of the goals opened or shut by the blocking means.

23. An air hockey game apparatus as claimed in claim 4, further comprising displaying means for displaying the open sizes of the goals opened or shut by the blocking means.

24. An air hockey game apparatus as claimed in claim 3, further comprising inputting means for inputting and specifying the open sizes of the goals, wherein the control means controls the drive condition of the blocking members to change the open sizes of the goals according to input signals of the inputting means.

25. An air hockey game apparatus as claimed in claim 24, wherein a pair of goals is provided on the puck sliding surface so as to oppose each other.

26. An air hockey game apparatus as claimed in claim 25, further comprising displaying means for displaying the open sizes of the goals opened or shut by the blocking means.

27. An air hockey game apparatus as claimed in claim 24, further comprising displaying means for displaying the open sizes of the goals opened or shut by the blocking means.

28. An air hockey game apparatus as claimed in claim 3, further comprising status determination means for determining a game status, wherein the control means controls the operational conditions of the blocking members to change the open sizes of the goals according to the game status determined by the status determination means.

29. An air hockey game apparatus as claimed in claim 28, wherein the game status determined by the status determination means is represented by scores of the air hockey game.

30. An air hockey game apparatus as claimed in claim 29, wherein a pair of goals is provided on the puck sliding surface so as to oppose each other.

31. An air hockey game apparatus as claimed in claim 30, further comprising displaying means for displaying the open sizes of the goals opened or shut by the blocking means.

32. An air hockey game apparatus as claimed in claim 29, further comprising displaying means for displaying the open sizes of the goals opened or shut by the blocking means.

33. An air hockey game apparatus as claimed in claim 28, wherein a pair of goals is provided on the puck sliding surface so as to oppose each other.

34. An air hockey game apparatus as claimed in claim 33, further comprising displaying means for displaying the open sizes of the goals opened or shut by the blocking means.

35. An air hockey game apparatus as claimed in claim 28, further comprising displaying means for displaying the open sizes of the goals opened or shut by the blocking means.

36. An air hockey game apparatus as claimed in claim 3, further comprising reacting means for reacting to movement of the puck, and the control means controls the drive condition of the blocking means to change the open size of the goals.

37. An air hockey game apparatus as claimed in claim 36, wherein a pair of goals is provided on the puck sliding surface so as to oppose each other.

38. An air hockey game apparatus as claimed in claim 37, further comprising displaying means for displaying the open sizes of the goals opened or shut by the blocking means.

39. An air hockey game apparatus as claimed in claim 36, further comprising displaying means for displaying the open sizes of the goals opened or shut by the blocking means.

40. An air hockey game apparatus as claimed in claim 3, wherein a pair of goals is provided on the puck sliding surface so as to oppose each other.

41. An air hockey game apparatus as claimed in claim 40, further comprising displaying means for displaying the open sizes of the goals opened or shut by the blocking means.

42. An air hockey game apparatus as claimed in claim 3, further comprising displaying means for displaying the open sizes of the goals opened or shut by the blocking means.

43. An air hockey game apparatus as claimed in one of claims 1 and 2, further comprising inputting means for inputting and specifying the open sizes of the goals, wherein the control means controls the operational conditions of the blocking members to change the open sizes of the goals according to input signals of the inputting means.

44. An air hockey game apparatus as claimed in claim 43, further comprising status determination means for determining the game status, wherein the control means controls the operational conditions of the blocking members to change the open sizes of the goals according to the game status determined by the status determination means.

45. An air hockey game apparatus as claimed in claim 44, wherein the game status determined by the status determination means is represented by scores of the air hockey game.

46. An air hockey game apparatus as claimed in claim 45, wherein a pair of goals is provided on the puck sliding surface so as to oppose each other.

47. An air hockey game apparatus as claimed in claim 46, further comprising displaying means for displaying the open sizes of the goals opened or shut by the blocking means.

48. An air hockey game apparatus as claimed in claim 45, further comprising displaying means for displaying the open sizes of the goals opened or shut by the blocking means.

49. An air hockey game apparatus as claimed in claim 44, wherein a pair of goals is provided on the puck sliding surface so as to oppose each other.

50. An air hockey game apparatus as claimed in claim 49, further comprising displaying means for displaying the open sizes of the goals opened or shut by the blocking means.

51. An air hockey game apparatus as claimed in claim 44, further comprising displaying means for displaying the open sizes of the goals opened or shut by the blocking means.

52. An air hockey game apparatus as claimed in claim 43, wherein a pair of goals is provided on the puck sliding surface so as to oppose each other.

53. An air hockey game apparatus as claimed in claim 52, further comprising displaying means for displaying the open sizes of the goals opened or shut by the blocking means.

54. An air hockey game apparatus as claimed in claim 43, further comprising displaying means for displaying the open sizes of the goals opened or shut by the blocking means.

55. An air hockey game apparatus as claimed in one of claims 1 and 2, further comprising status determination means for determining a game status, wherein the control means controls the operational conditions of the blocking members to change the open sizes of the goals according to the game status determined by the status determination means.

56. An air hockey game apparatus as claimed in claim 55, wherein the game status determined by the status determination means is represented by scores of the air hockey game.

57. An air hockey game apparatus as claimed in claim 56, wherein a pair of goals is provided on the puck sliding surface so as to oppose each other.

58. An air hockey game apparatus as claimed in claim 57, further comprising displaying means for displaying the open sizes of the goals opened or shut by the blocking means.

59. An air hockey game apparatus as claimed in claim 56, further comprising displaying means for displaying the open sizes of the goals opened or shut by the blocking means.

60. An air hockey game apparatus as claimed in claim 55, wherein a pair of goals is provided on the puck sliding surface so as to oppose each other.

61. An air hockey game apparatus as claimed in claim 60, further comprising displaying means for displaying the open sizes of the goals opened or shut by the blocking means.

62. An air hockey game apparatus as claimed in claim 55, further comprising displaying means for displaying the open sizes of the goals opened or shut by the blocking means.

63. An air hockey game apparatus as claimed in one of claims 1 and 2, further comprising reacting means for reacting to movement of the puck, and the control means controls the drive condition of the blocking means to change the open size of the goals.

64. An air hockey game apparatus as claimed in claim 63, wherein a pair of goals is provided on the puck sliding surface so as to oppose each other.

65. An air hockey game apparatus as claimed in claim 64, further comprising displaying means for displaying the open sizes of the goals opened or shut by the blocking means.

66. An air hockey game apparatus as claimed in claim 63, further comprising displaying means for displaying the open sizes of the goals opened or shut by the blocking means.

67. An air hockey game apparatus as claimed in one of claims 1 and 2, wherein a pair of goals is provided on the puck sliding surface so as to oppose each other.

68. An air hockey game apparatus as claimed in claim 67, further comprising displaying means for displaying the open sizes of the goals opened or shut by the blocking means.

69. An air hockey game apparatus as claimed in one of claims 1 and 2, further comprising displaying means for displaying the open sizes of the goals opened or shut by the blocking means.

* * * * *